United States Patent [19]

Phillips et al.

[11] 4,316,232

[45] Feb. 16, 1982

[54] ELECTRIC FENCE CONTROLLERS

[76] Inventors: Dougald S. M. Phillips; Carol L. E. Phillips; David L. D. Phillips, all of 45 Fifth Ave., Hamilton, New Zealand

[21] Appl. No.: 146,603

[22] Filed: May 5, 1980

[30] Foreign Application Priority Data

May 7, 1979 [NZ] New Zealand ..... 190389
Jul. 31, 1979 [NZ] New Zealand ..... 191177

[51] Int. Cl.[3] ..... H05C 1/04
[52] U.S. Cl. ..... 361/232; 256/10
[58] Field of Search ..... 361/232; 256/10

[56] References Cited

U.S. PATENT DOCUMENTS 2,401,815 6/1946 Dalzlel ..... 361/232
3,868,545 2/1975 Caron ..... 361/232
3,900,770 8/1975 Kaufman ..... 361/232
4,114,185 9/1978 Gallagher ..... 361/232

FOREIGN PATENT DOCUMENTS 1033778 7/1958 Fed. Rep. of Germany ..... 361/232
2724302 11/1978 Fed. Rep. of Germany ..... 361/232
832927 10/1938 France ..... 361/232
1233892 6/1971 United Kingdom ..... 361/232

*Primary Examiner*—J. D. Miller
*Assistant Examiner*—L. C. Schroeder
*Attorney, Agent, or Firm*—Holman & Stern

[57] ABSTRACT

An apparatus to energize electrical fences is disclosed which provides pulses at random or irregular intervals in order that animals maintained in such a fence do not become accustomed to a particular pattern.

9 Claims, 3 Drawing Figures

Figure 1:
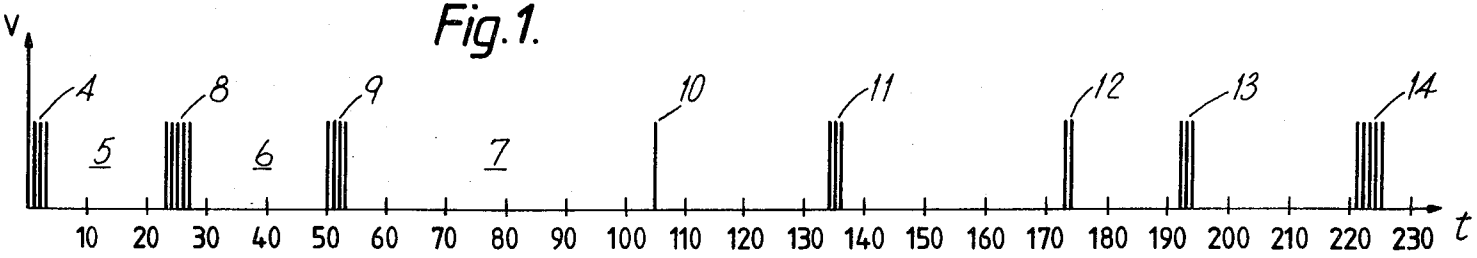

V
t
4
5
6
7
8
9
10
11
12
13
14
10 20 30 40 50 60 70 80 90 100 110 120 130 140 150 160 170 180 190 200 210 220 230

POWER SUPPLY
1
2
3

V
t
4
5
6
7
8
9
10
11
12
13
14
19
10 20 30 40 50 60 70 80 90 100 110 120 130 140 150 160 170 180 190 200 210 220 230

ELECTRIC FENCE CONTROLLERS

This invention relates to electric fence energisers.

Research on dairy cows has shown that the pattern of application of stimuli is important in determining behaviour. Experiments have shown that if pleasant stimuli are applied a more favourable animal response is obtained if the application of the stimuli is not on a regular basis. As an example, the provision of a small palatable meal supplement at milking time will encourage cows to enter the milking shed if the meal is provided infrequently and on a random basis. A regular supply of meal at each milking does not have this enhancing effect as the cows are aware that the meal will be provided on a regular basis and the behaviour is not reinforced.

In a similar way it has been found that animals show the same kind of behaviour pattern when adverse stimuli are applied. In experiments in which cows received small electric shocks at milking time, it was found that the experimental animals very quickly adapted to a known pattern of shocks administered at specific stages of milking at every milking. While these cows showed signs of distress and were visibly affected they still continued to come into the shed in a fairly normal way and responded normally to milking after an initial period of adjustment.

In a subsequent trial the cows were subjected to the same level of electric shock, but applied at random at 3 milkings out of every 14. Under these conditions the cows became extremely apprehensive and it was very difficult to get them into the milking bail. The cows were terrified of the shed and showed signs of fear with shaking and trembling at all milkings. The response to the occasional shocks was much more severe than when a predictable pattern was used. In some cases the reaction to treatment was such that cows were almost incapable of walking into the shed and had to be physically "carried" in.

Animals are frequently prepared to withstand the shocks delivered by an electric fence during an attack on the fence. Some cattle will deliberately "rush" fences knowing that they will receive one or two shocks on the way through.

Also it is know that cattle can sense the operation of an electric fence by feeling the impulses due to leakage from fence standards through the ground. Cows are sensitive to as little as 2.0 volts between hind and fore feet, and small voltage gradients across the ground surface near electric fences are readily detected. Under these conditions the stock are aware that a fence is un-energized and will walk over a broken fence wire. Commonly a cow will graze under a wire until the wire is gently touching the hair and a small shock will indicate that it has proceeded far enough. Thus currently available electric fence systems have disadvantages.

It is an object of the present invention to provide an electric fence energiser which will go at least some distance towards obviating or minimising the foregoing disadvantages or which will at least provide the public with a useful choice.

Accordingly the invention consists in an electric fence energiser capable of supplying pulse sequence to one or more electric fences, said electric fence energiser including controlling means to provide in use a pulse sequence the composition of which is unpredictable to an animal.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Figure 2:
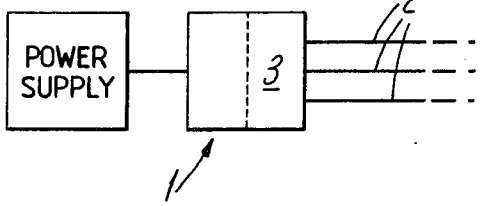
Figure 4:
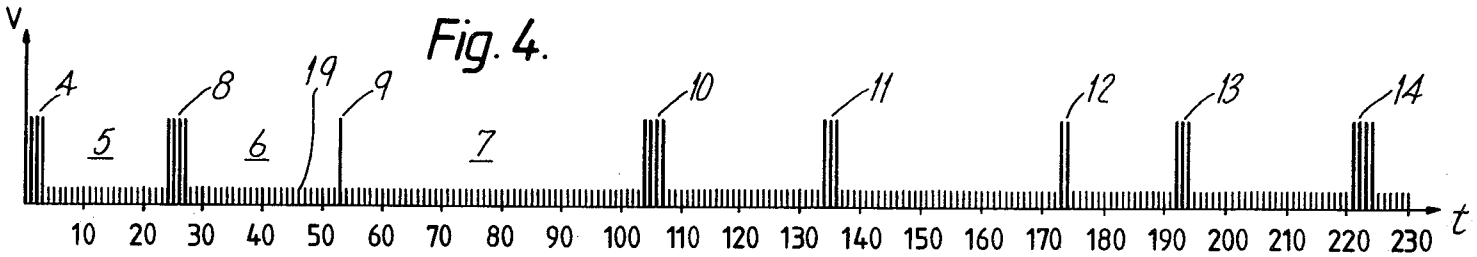
Figure 3:
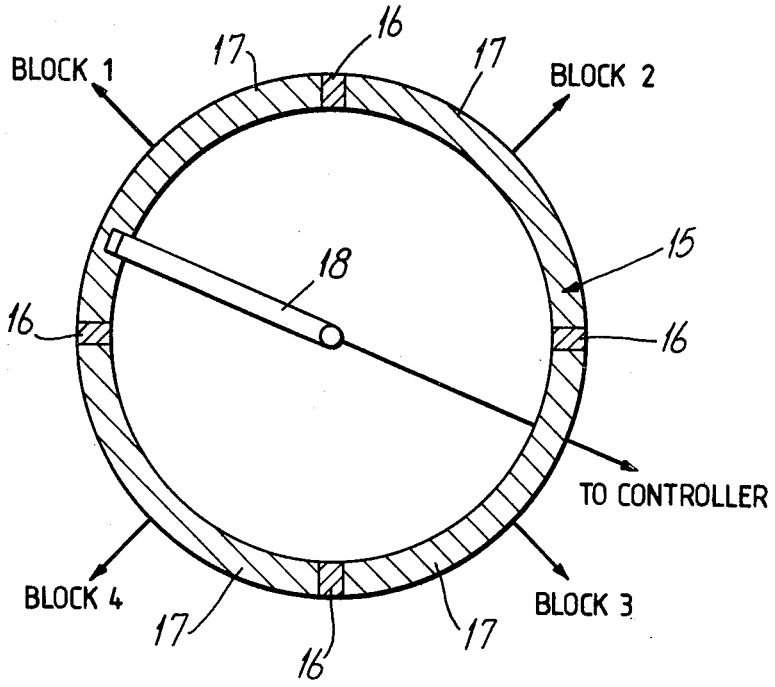

One preferred form of the invention will now be described with reference to the accompanying drawings in which:

FIG. 1 is a diagrammatic plot of electric fence energiser output against time (in seconds) for one embodiment of the invention, FIG. 2 is a simple block diagram of an electric fence energiser according to the invention in use, FIG. 3 is a plot as in FIG. 1 for an alternative embodiment of the invention; and FIG. 4 is a diagrammatic plan view of a distribution means for use in a multi-fence embodiment of the invention.

In the preferred form of the invention an electric fence energiser 1 is provided which applies a sequence of electric voltage pulses to one or more electric fence wires 2. The electric fence energiser 1 includes controlling means 3 whereby the composition of the pulse sequence is unpredictable to animals. It is envisaged that time gaps between pulses or bursts of pulse can vary, and also the voltage of pulses, the number of pulses in multiple pulse bursts and the length of a pulse.

In one embodiment of the invention varying gaps between pulses are provided and it is envisaged that the output pulse sequence would comprise groups of relatively closely spaced pulses, separated by relatively lengthy time gaps between the groups. If desired, the time delays may be of variable length and also the number of pulses per group the voltage and the pulse length may be variable in a manner unpredictable to animals. Thus the variations may be patterned, semi-patterned, random or otherwise irregular.

Thus referring to FIG. 1 a group of pulses 4 may be provided to an electric fence 2, the group containing say, 3, 4 or 5 pulses at normal intervals such as about 1 pulse per second. A longer time delay period 5 then occurs and the longer time delay period 5 may be for example a time period equivalent to the period usually occupied in providing 20 or 30 pulses at the repetition rate of currently used electric fence energisers. Longer or shorter periods may be used.

For example the delay may comprise a period 6 of about half a minute although delays 7 of a minute are acceptable. In fact, even longer delays may prove in use to be acceptable. The delay between pulse burst 4 and succeeding pulse shocks 8.9,10,11,12,13 and 14 may be and preferably is variable. As can be seen from FIG. 1 and FIG. 4 the number of pulses per pulse burst is desirably varied in an irregular manner.

Such pulse sequences could be supplied in many ways and for example the electric fence energiser 1 includes a controlling means (representationally shown at 3) whereby the time gap is not held constant i.e. the longer gaps are introduced: The controlling means 3 may comprise one or more of several alternatives and such alternatives include a switch or switching circuits which switches are energiser for example between states in which a pulse sequence is despatched and states in which a pulse sequence is not despatched. There are numerous methods by which this effect could be achieved and for example an electronic counter could be used which would switch on the fence pulse for a sequence of say 3 or 4 pulses and then switch the fence pulse off for the next say 20 to 60 pulses. In an alternative construction a low frequency timing circuit could be provided which pulses for a few seconds during which fence pulses are delivered to an electric fence and then switches to a standby stage where a preset period of for example ½-1 minute which period need not be well controlled and some variability may be an advantage in the construction.

In a still further alternative a mechanical switching system could be provided which turns on the energiser to deliver a few pulses say every ½ to 1 minutes as required.

The precise method of switching is itself not of the essence to the invention, the significant factor in the invention in the embodiment above described being the provision of a short sequence of pulses at short intervals followed by a longer period which can be of variable lengths during which no output pulses are delivered.

In an alternative construction a plurality of electric fences 2 may be provided for example on a farm where a whole farm is subdivided by electric fencing. Such systems are used on many dairy farms for example. In these circumstances the farm is often divided into a number of separate blocks each of which has a connection back to the central control point. Each block can be turned on or off as stock are moved about the farm so that energiser power is not wasted by the operation of unused blocks and the available stock is thus maintained at a good working level. In many installations the maintenance of adequate shock level is achieved by using several energisers each connected to a separate block on a farm. This is effective but expensive in the provision of energisers. The intermittent system described here can be used to advantage in this type of layout. By using a distributor type of switch it is possible to connect the fence energiser in sequence to each block of the farm fencing system and each block would receive the full energiser output during this period. The delays are thus provided during the time when the distributor is not directing pulse sequences to a particular fence. The switching for such a distributor could be achieved in a number of ways either by means of a motor driven rotary switch or by solid state switches operated from an electronic control unit which generates a switching pulse through standard logic circuitry. The connection to the blocks could be made for example by a conductive ring 15 having insulators 16 therein dividing the ring 15 into a number of arcs 17 each connected to a fence block. The input from the energiser 1 could be to a centrally mounted wiper arm 18 which rotates so as to pass around the ring 15. Thus the arm 18 moves sequentially from the part of the ring relating to one block to the other parts of the ring in sequence.

Thus it can be seen that in the embodiments of the invention described above an electric fence energiser is provided which is capable of providing pulses to electric fences in a manner such that the time gap between pulses is irregular. In particular, the time gap varies between a group of relatively closely spaced pulses before a relatively long time gap is provided.

Alternatively in an alternative embodiment of the invention or in conjunction with the above embodiment, a sequence of low voltage intensity pulses 19 are supplied over a period of say 20–30 pulses (e.g. periods 5,6,7) followed by a short sequence (e.g. trains 4,8,9,10,11,12,13,14) or normal high intensity pulses, for say 3–5 pulse intervals as in the first embodiment. This would have much the same effect as the original system in which a period of no pulses was followed by a short sequence of normal high intensity pulses. The interval between pulses would generally be approximately 1.0 second.

The actual relative level of the pulses in the two pulse sequences is a matter of choice or could be determined experimentally to achieve the best response for the particular type of animal concerned. It would also be possible to use a system where the usual pulse output is at a relatively low voltage level and at random intervals of say 0–30 pulses the pulse intensity is switched to a high intensity (i.e. higher voltage level) for 1–5 pulses. For dairy cows the voltage of high high intensity pulses would normally be substantially the same as those currently used. The low voltage pulses, are desirably substantially less.

The electric fence controller of the invention is used substantially as hereinbefore described. The manner of connection to fences and other requirements of use are substantially as for conventional electric fence energisers.

In at least the preferred form of the invention advantages are present in that an animal which was prone to attack a fence would, whether either or both systems above described were being used, never know whether to expect a shock or not and expermiment has shown that the decision to be made by the animal is not an acceptable decision for that animal to make. Stock grazing up to an electric fence would be fully in contact with the fence before a shock or large shock was delivered so that the effect would be severe and the animals would soon learn to treat the fence wire thus electrified with respect. The failure of an energiser would also have a less serious effect in that the animals grazing near the fence wire would not know that the system was in-operative. It is believed that stock would not be able to adapt to a fence wire having pulses of the type described herein applied thereto and therefore the fence will become a psychological barrier even if no shocks are applied over a considerable period. Thus the energy input can be reduced to a very low level and a dry battery supply could give a substantial shock but still operate over many months. Similarly solar or wind powered units could operate at a high shock level from a very small average power input to the storage batteries. The system would also therefore be particularly suitable for large properties where fencing is often remote from the power supplies and would also be suitable for under developed areas where mains power is generally not available. That is to say, the system is potentially capable of providing much enhanced stock response to the fence whilst at the same time increasing battery life of the energiser as well as reducing wear and tear on the energiser itself.

The multiple fence systems described herein also has advantages, in particular, greater economy is achieved from the use of a single energiser in a place of several, improved performance from the use of a controller is achieved with smaller blocks of fencing and enhanced response is achieved resulting from the intermittent pulse train therein described.

The use of irregular high intensity pulses among low intensity pulses would produce an unpredictable situation which would produce a high level response from the animals.

The preferred form at least of the invention therefore has the following advantages:

1. The irregular pulse pattern allows a smaller battery or solar panel to be used or provides a longer battery life.
2. Stock effectiveness can be maintained over a greater fence length whilst using a battery or solar power unit comparable to conventional units. It is believed that stock effectiveness can be maintained over fence lengths comparable to mains operated units.
3. A psycological barrier to animals is provided.

What I claim is:

1. An electric fence energiser capable of supplying pulse sequence to one or more electric fences, said electric fence energiser including controlling means to provide in use during normal operation an irregular pulse sequence the composition of which is unpredictable to an animal.

2. An electric fence energiser as claimed in claim 1 wherein said pulse sequence comprises groups of relatively closely spaced pulses separated by time gaps between said groups of closely spaced pulses.

3. An electric fence energiser as claimed in either claim 1 or claim 2 wherein said fence energiser includes switching means to switch the energiser between a state in which a pulse sequence is despatched and a state in which a pulse sequence is not despatched to thereby provide said long time gaps.

4. An electric fence energiser as claimed in either claim 1 or claim 2 wherein said electric fence energiser sequentially applies pulses to a plurality of fence wires so that periods when pulses are being sent along one fence wire provide the relatively long time gaps on the or each other fence wire.

5. An electric fence energiser as claimed in either claim 1 or claim 2 wherein said time delays are of variable length.

6. An electric fence energiser as claimed in either claim 1 or claim 2 wherein the number of pulses per group is variable.

7. An electric fence energiser as claimed in claim 1 or claim 2 wherein the length of said pulses is variable.

8. An electric fence energiser as claimed in either claim 1 or claim 2 wherein one or more pulses having a low voltage intensity is followed by one or more pulses having a high voltage intensity.

9. An electric fence energiser as claimed in claim 8 wherein the number of low voltage intensity pulses substantially exceeds the number of high voltage intensity pulses.

* * * * *